US009820519B2

(12) United States Patent
Jung et al.

(10) Patent No.: US 9,820,519 B2
(45) Date of Patent: Nov. 21, 2017

(54) AUTOMATIC 3D GARMENT CONSTRUCTION FROM TAGGED CLOTH PANELS

(71) Applicants: Ilhoe Jung, Seoul (KR); Hyeong-Seok Ko, Seoul (KR)

(72) Inventors: Ilhoe Jung, Seoul (KR); Hyeong-Seok Ko, Seoul (KR)

(73) Assignee: PHYSAN, INC., Seoul (KR)

( * ) Notice: Subject to any disclaimer, the term of this patent is extended or adjusted under 35 U.S.C. 154(b) by 336 days.

(21) Appl. No.: 14/790,235

(22) Filed: Jul. 2, 2015

(65) Prior Publication Data

US 2017/0000203 A1 Jan. 5, 2017

(51) Int. Cl.
*A41D 27/24* (2006.01)
*A41H 3/04* (2006.01)

(52) U.S. Cl.
CPC ..... *A41D 27/24* (2013.01); *A41H 3/04* (2013.01)

(58) Field of Classification Search
CPC ..... A41H 3/04; A41H 3/007; A41H 1/02; A41H 42/00; A41H 21/00; G06F 2217/32; G06F 17/50; G06F 17/5018; G06Q 30/0621; G06Q 50/04; G06Q 10/043; G06Q 30/0643; A41D 27/24
See application file for complete search history.

(56) References Cited

U.S. PATENT DOCUMENTS 5,865,467 A * 2/1999 Bito ..... B60R 21/231 280/728.1
2013/0305547 A1* 11/2013 Grove ..... A41H 3/007 33/17
2015/0059042 A1* 3/2015 Aquino ..... F41H 1/02 2/2.5

OTHER PUBLICATIONS

[1982 Haralick] Understanding engineering. drawings, Artificial Intelligence.
[1998 David Baraff, Andrew Witkim] Large Steps in Cloth Simluation, US, SIGGRAPH.
[2002 Kwang-Jin Choi, Hyeong Seok Ko] Stable but Responsive Cloth, KR.
[2002 Takeo Igarashi, John F. Hughes] Clothing Manipulation.
[2002 Dimitris Protopsaltou and 3 more] A body and garment creation method for an internet-based virtual fitting room, Switzerland.

(Continued)

*Primary Examiner* — Devona Faulk
*Assistant Examiner* — Kevin Wu
(74) *Attorney, Agent, or Firm* — John K. Park; Park Law Firm

(57) ABSTRACT

An automatic 3D garment construction is provided using steps for: providing a plurality of panels of a garment so as to be processed in an information processing device, wherein each of the plurality of panels comprises seam lines; positioning the plurality of panels at corresponding locations around a virtual body provided in the information processing device; finding matching seam lines for the plurality of panels and creating seams; and producing the garment in which the plurality of panels are positioned, seamed, and draped on the virtual body. The step for positioning may comprise a step for panel tagging, a step for seam line tagging, and a step for panel packing, in which related panels are grouped and packed, such that relative positions are fixed among the packed panels, and the packed panels move as a group.

7 Claims, 10 Drawing Sheets

(a) (b)

(56) References Cited

OTHER PUBLICATIONS

[2003 Frederic Cordier, and 2 more] Made-to-measure technologies for an online clothing store.
[2003 Eitan Grinspun, and 4 more] Discrete Shells, Eurographics/SIGGRAPH.
[2003 J.B. Mena] State of the art on automatic road extraction.
[2003 Charlie C.L. Wang and 2 more] Feature based 3D garment design through 2D sketches.
[2004 Emmanuel Turquin and 2 more] Sketching garments for virtual characters.
[2005 Marzia Fontana and 3 more] Clothassembler a cad module for feature-based garment.
[2006 Philippe Decaudin and 5 more] A Fully Geometric Approach for Clothing Design.
[2007 Emmanuel Turquin and 4 more] A Sketch-Based Interface for Clothing Virtual Characters.
[2010 Yuwei Menga and 2 more] Interactive virutual try-on clothing design systems.
[2011 Cody Robson and 3 more] Context-aware garment modeling from.
[2011 Nobuyuki Umetani and 3 more] Sensitive Couture for Interactive Garment Modeling and Editing.
[2012 Floraine Berthouzoz and 2 more] Tools for Placing Cuts and Transitions in Interview Video.
[2012 Peng Guan and 3 more] Drape_Dressing any person.
[2012 Yuwei Menga and 2 more] Computer aided clothing pattern design with 3D editing and pattern alteration.
[2012 Yuwei Menga and 2 more] Flexible shape control for automatic resizing of apparel products.

* cited by examiner (a) (b)

AUTOMATIC 3D GARMENT CONSTRUCTION FROM TAGGED CLOTH PANELS

BACKGROUND OF THE INVENTION

The present invention relates to a method for automatic 3D garment construction from tagged cloth panels.

SUMMARY OF THE INVENTION

The present invention contrives to solve the disadvantages of the prior art.

As aspect of the invention provides a method for constructing 3D garment.

The method comprises steps for:

providing a plurality of panels of a garment so as to be processed in an information processing device, wherein each of the plurality of panels comprises seam lines;

positioning the plurality of panels at corresponding locations around a virtual body provided in the information processing device;

finding matching seam lines for the plurality of panels and creating seams; and producing the garment in which the plurality of panels are positioned, seamed, and draped on the virtual body.

The step for positioning may comprise a step for panel tagging, in which each of the plurality of panels is tagged by a user based on a cylindrical abstraction, such that the panel is positioned properly.

The step for positioning may further comprise a step for seam line tagging, in which each of the seam lines is tagged by the user, such that the matching seam lines are related properly.

The step for positioning may further comprise a step for panel packing, in which related panels are grouped and packed, such that relative positions are fixed among the packed panels, and the packed panels move as a group.

A panel may be tagged as $(\alpha,\beta,\gamma)$, in which $\alpha$, $\beta$, and $\lambda$ are predicates regarding P, wherein $\alpha$ designates the particular cylinder, and $\beta$ takes either Front or Back, and $\lambda$ represents the layer to which P belongs.

$\lambda=\pm1, \pm2, \ldots$ to encode the outer/inner layers.

The step for positioning may comprise a step for determining:

if the line pair to be sewn together is positioned sufficiently close;

if panels do not penetrate the body; and if a seam sweep (the sweep defined between the matching seam line pair) does not penetrate the body.

The step for positioning may further comprise a step for traslating the panels while attached to a surface of cylinder for the cylindrical abstraction.

The step for creating seams may comprise a step for classifying the seams into three categories:

intra-pack seams used for seaming seam lines belonging to a same pack;

inter-pack seams used for seaming seam lines belonging to two different packs; and inter-layer seams consisting of T-seams and Y-seams, wherein the seam is made with an interior line in the T-seam, and multiple panels are seamed with a single contour in the Y-seam.

The inter-pack seams may be further categorised into the inter-half-cylinder seams (that join the front and back half cylinders) and the inter-cylinder seams (that join two cylinders).

The Y-seam lines may be explicitly tagged through a secondary seam line tagging by the user.

The probability whether two candidate lines in 3D are inter-pack seamed may be estimated using criteria including:

$M_{ld}$: The distance is short;

$M_{lo}$: The FOV of the two planar normals is small;

$M_{ll}$: The length should be similar;

$M_{lc}$: The curvature should be similar; and $M_{sa}$: The lines should be seamable.

An objective function M (i, j) used for finding the matching inter-pack seam lines may be defined as $$M(i, j) = M_{ld}(i, j)M_{lo}(i, j)M_{ll}(i, j)M_{lc}(i, j)M_{sa}(i, j), \text{ where} \tag{1}$$

$$M_{ld}(i, j) = \frac{d_{max} - \|p_i - p_j\|}{d_{max}}, \tag{2}$$

$$M_{lo}(i, j) = \frac{1 - n_i \cdot n_j}{2}, \tag{3}$$

$$M_{ll}(i, j) = \frac{L_{diff} - |L_i - L_j|}{L_{diff}\kappa_{diff}}, \tag{4}$$

$$M_{lc} = \frac{-|\kappa_i - \kappa_j|}{\kappa_{diff}} \tag{5}$$

$$M_{sa}(i, j) = 0 \text{ or } 1. \tag{6}$$

in which Eq. (2) represents the proximity, where $d_{max}$ is the threshold distance (a controllable parameter), $p_i$ and $p_j$ are the positions of line i and j, Eq. (3) represents the orientation match, where $n_i$, $n_j$ are the planar normals of line i and j, respectively, Eq. (4) represents the length match, where $L_{diff}$ is the threshold length difference (a controllable parameter), $L_i$ and $L_j$ are the lengths of line i and j, respectively, Eq. (5) represents the curvature match, where κdiff is the threshold curvature difference (a controllable parameter), $\kappa_i$ and $\kappa_j$ are the curvatures of line i and j, respectively, and Eq. (6) represents the seamability, which takes either zero or one based on the line pair's inherent and conventional unseamability.

Matching inter-cylinder seam lines may be identified by steps for:

for a particular line i, calculating the objective function value M (i, j) for all the adjacent lines j in the other cylinder to find the best individual match for i; and finding the best ring match by rotating the distal cylinder about the axis and calculating the circumferential summation of N (i, j).

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Referring to the figures, the embodiments of the invention are described in detail.

1. INTRODUCTION

These days, it is an emerging trend to shop clothes in on-line, and as a consequence, there is a huge demand for the development of virtual try-on systems. An example can be viewed at metail.com, in which the user can try the clothing on her/his own avatar. To run a virtual try-on system, an obvious but important necessary condition is that the garments for sale must exist in the system. This paper is about automatic construction of the garment from the input of the comprising panels (i.e., the sewing patterns).

Figure 2:
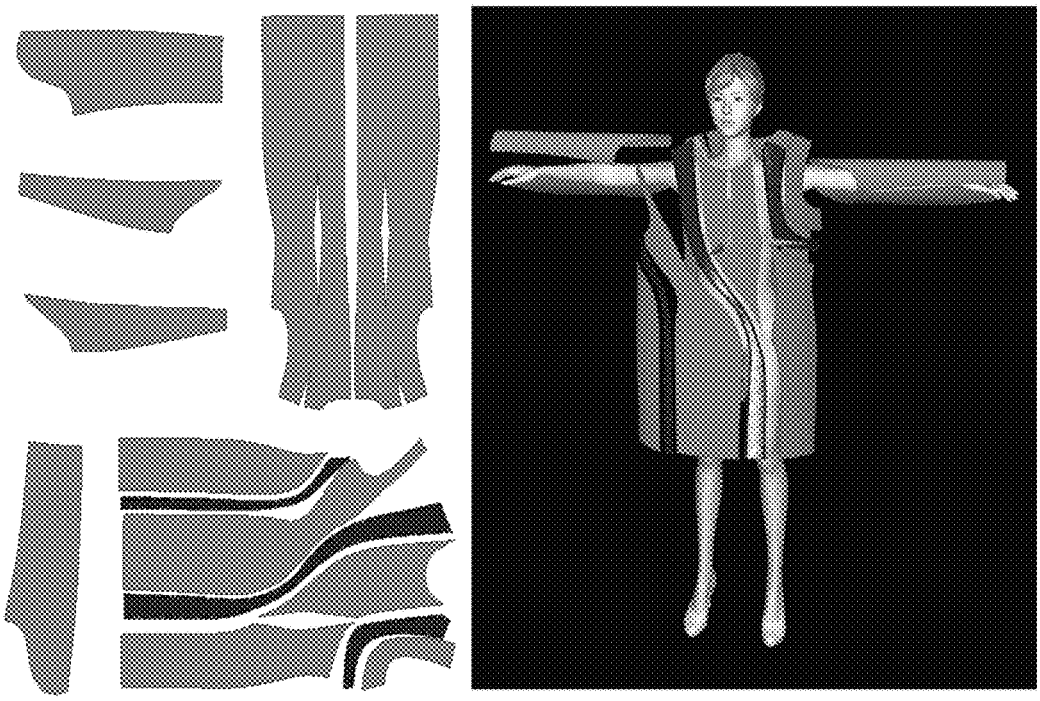
FIG. 2 shows manual construction of the garment: (a) the given panels, (b) positioning of each panel with 3D manipulation.

For the past ten years, the authors have an experience of educating the fashion people how to use the clothing simulation software to construct various types of garments. They are fascinated to see the simulated results, but when they try constructing the garments themselves, the magic suddenly turns into frustration. For example, consider a simple garment consisting of the panels shown in FIG. 2(*a*). Positioning the panels around the body and creating seams between them calls for hundreds of panel-dragging and view changes in the 3D window, and a small mistake can produce a surprising outcome. Even to expert users, the task is cumbersome and laborious. The computer graphics field has made remarkable progress in the accuracy and speed of physical simulation, but it has made relatively less progress in enhancing the usability.

The above inconvenience becomes a must-solve problem if such construction should be done for thousands of garments per week, which is easily the case to run a commercial virtual try-on system. The ideal scenario would be the program can automatically construct the garment without any tip from the user, which is unfortunately impossible. (In fact, it is an ill-posed problem.) From the perspective of usability, the following two principles have been identified:

Determinism: Sure-success is preferred to occasional failure, even if the method calls for some tips from the user.

Dimensional Overhead: Simple labeling is preferred to 2D or 3D manipulation. If manipulation needs to be done (to the panels), doing it in 2D is preferred to doing it in 3D.

This paper proposes a new technique based on the above two principles, which lets the computer do the construction job (panel positioning and seam creation) in a deterministic way. The technique requires the user to do some preparation for the comprising panels. But the required preparation is simple labeling or manipulation in the 2D window. The proposed method turns out to very effectively relieve the attention-intensive work in the preparation of virtual garments. Before revealing the method, we highlight that (1) the above frustration has remained largely unsolved for more than a decade, and to our knowledge, (2) this is the first practically workable solution to that problem.

2. RELATED WORK

A work that is relevant to this paper is Berthouzoz et al. [2013], which extracts panels from a PDF file and parses sewing patterns to construct the virtual garment automatically. This machine-learning based method needs to have some training data set, but instead, the method does not call for any tips from the user. It is a probabilistic model, thus success is not guaranteed. They reported the success ratio was about 68%. The success ratio can be affected when the user constructs a garment the type of which is different from the ones in the training data set.

In contrast to Berthouzoz et al. [2013], this paper proposes a deterministic method (The proposed method also contains some probabilistic ingredient. However, compared to Berthouzoz et al. [2013], the probabilistic ingredient is much less.), which does not call for the training data set, and as long as the input garments are within the inherent range of the method its success ratio is over 99%. The key idea of our method is that, if the program positions the panels at sensible locations, the spatial relationship (e.g., adjacency, distance in 2D) between lines can be a crucial key for identifying the seam line pair. Concluding that finding out the sensible location of the panels can't be done without any tip, this paper devises a systematic way for the user to provide the tip: panel tagging and packing.

Meng et al. [2010] employed a hierarchy of ellipsoids to find the optimal position of the panels around the body. For the creation of complex garments, they proposed four types of user interactions to control the panel position, namely, move, rotate, fix, and drag. Introduction of the cylinders facilitated the positioning task, but the construction was not done automatically; It required a considerable amount of 3D manipulation from the user.

Automatic garment construction is a pretty new direction of research, thus there are not many papers that focus on the specific problem this paper is trying to solve. Berthouzoz et al. [2013] excellently summarizes the previous work in general on (1) parsing diagrams [Haralick and Queeney 1982; Mena 2003], (2) sketch-based garment design [Wang et al. 2003; Turquin et al. 2004; Turquin et al. 2007; Decaudin et al. 2006; Robson et al. 2011], and (3) creation and fitting of sewing patterns [Protopsaltou et al. 2002; Igarashi and Hughes 2002; Cordier et al. 2003; Fontana et al. 2005; Umetani et al. 2011; Meng et al. 2012a; Meng et al. 2012b; Guan et al. 2012], thus this paper full-heartedly refers to Berthouzoz et al. [2013].

3. OVERVIEW

Figure 3:
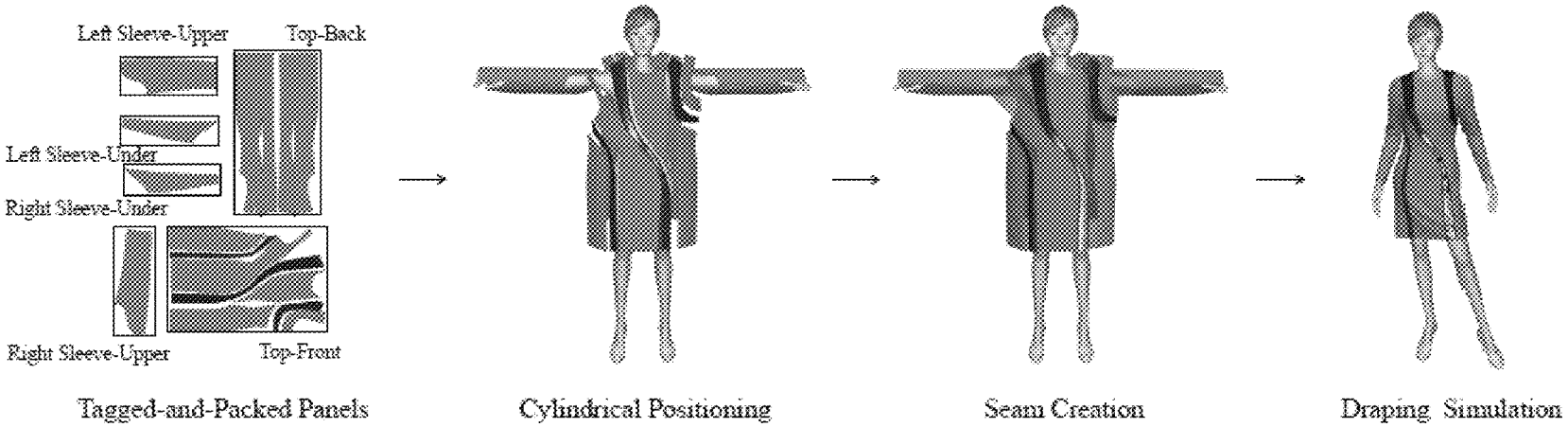
FIG. 3 shows an overview of the invention.

The proposed tagging-based automatic garment construction (TAGCON) method takes the tagged-and-packed panels (which do not need to be positioned with respect to the body), then produces the completed (positioned, seamed, draped) garment in 3D as shown in FIG. 3.

1. Cylindrical Positioning: Locates the panels on the surface of cylinders (FIG. 4) to embrace the avatar.
2. Seam Creation: Identifies the line pairs to be seamed.

3. Draping Simulation: Performs the physically-based simulation of the constructed garment on the avatar.

The tag-and-pack (the details of which is presented in Section 4) is not a big overhead to the pattern-making expert, but provides essential tips to the TAGCON, resulting in a significant reduction of the construction efforts.

4. TAG-AND-PACK

In the clothing field, often people name the panel according to the position the panel occupies during the garment construction. A few examples are the top front panel and right sleeve panel, which enable us to guess where they should be positioned for the construction. Berthouzoz et al. [2013] referenced the panel name for identifying the matching seam line pairs. Unfortunately, each manufacturer may use different naming scheme; The name may not have anything to do with the panel's 3D position.

4.1 Panel Tagging

The panel tagging this paper proposes is basically a convention that every panel should be named according to a rule. A question arises if there is any systematic way to name the panels. We note that the tagging must satisfy the following two conditions:

Coverage with Fixed Key Words: The tagging should involve only a fixed number of key words; The number of key words should not increase as more diverse garments are processed.

Position Encoding Capability: The tagging should be able to uniquely determine the panel's body-relative (sensible) position.

An important finding of this paper is that such a tagging convention exists. In fact, we propose one such tagging scheme based on the cylindrical abstraction of the situation. Topologically, we note that any garment can be abstracted as a number of cylinders. For example, a T-shirt can be abstracted as consisting of the top, left sleeve, and right sleeve cylinders, a subset of the cylinders shown in FIG. 4.

Figure 4:
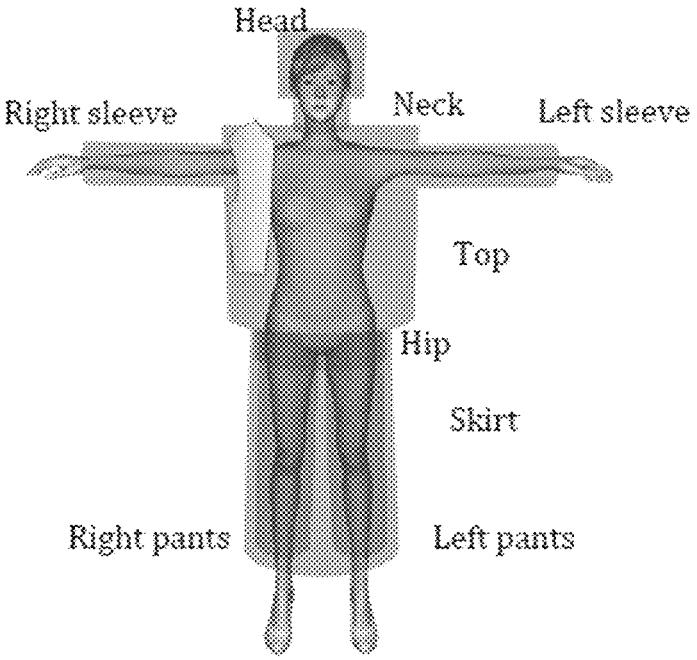
FIG. 4 shows a cylindrical abstraction.
Figure 5:
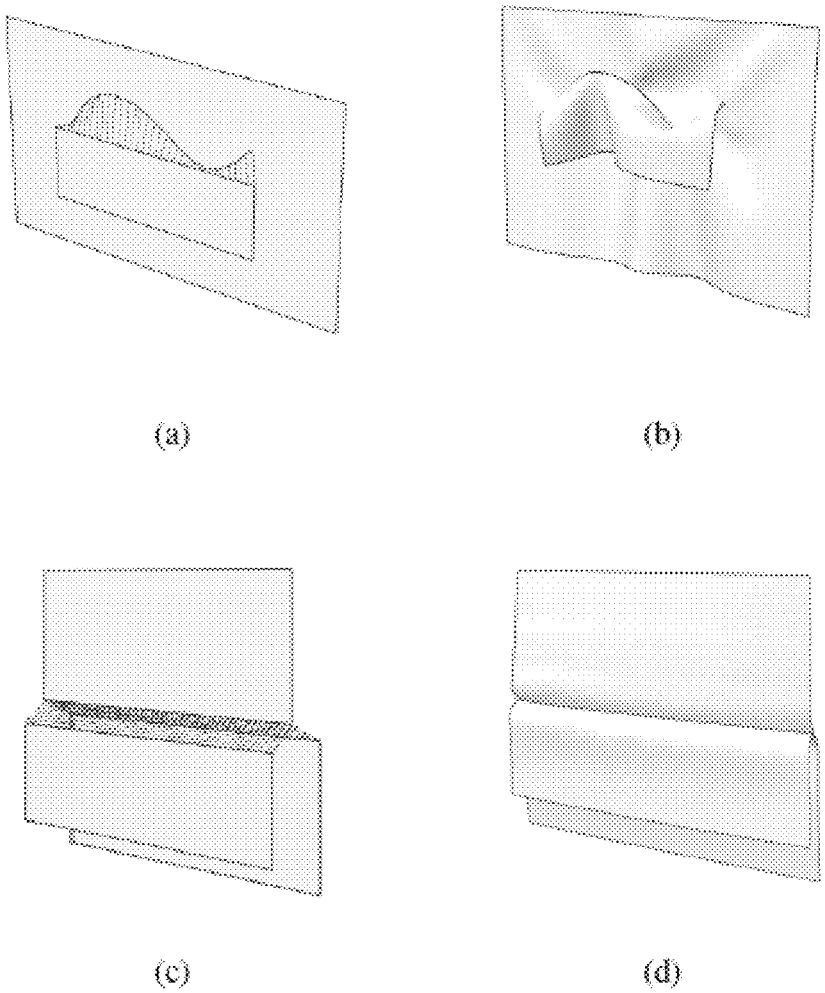
FIG. 5 shows T-seam and Y-seam, (a)-(b): T-seam before and after the simulation, (c)-(d): Y-seam before and after the simulation.

In the context of the cylindrical abstraction, we tag the panel P as ($\alpha$, $\beta$, $\lambda$) in which $\alpha$, $\beta$, and $\lambda$ are predicates regarding P. $\alpha$ designates the particular cylinder, and $\beta$ takes either Front or Back. For example, (Top, Front, $\lambda$) panel can be positioned on the cylindrical surface as shown in FIG. 4. A represents the layer to which P belongs. In most garments, $\lambda=0$ for all the panels. However, in the cases shown in FIG. 5, the panels need to be ordered in-to-out. $\lambda=\pm1, \pm2, \ldots$ are used to encode the outer/inner layers. The case shown in FIGS. 5(*a*) and (*b*) in which the seam is made with an interior line is called the T-seam. The case shown in FIGS. 5(*c*) and (*d*) in which multiple panels are seamed with a single contour is called the Y-seam. We will call the other (usual) seams as normal seams. We note that layering of the panels is essential to be able to construct complex garments, and such situation would not be identifiable without the tip from the user.

There is another kind of tagging to be done, namely the seam line tagging, (In contrast, we will call the above ($\alpha$, $\beta$, $\lambda$) as the panel tagging), that tags whether each line segment will participate to a seam. Berthouzoz et al. [2013] does not require the seam line tagging. Their method performs this classification probabilistically. We note that the clothing experts strongly prefer the deterministic situation; The seam line tagging is not a big overhead therefore they would rather do the seam line tagging than obtaining occasionally incorrect results.

Some of the seam lines tagged above need further classification. We call it the secondary seam line tagging, which should be done to the T- and Y-seams. The T-seam lines can be identified by the program without user specification, but the Y-seam lines need to be explicitly tagged as such by the user.

Note that all the algorithms presented in this paper assume that a single garment is constructed. If the user wants to create multiple garments, e.g., a blouse and pants, he/she has to run TAGCON twice, once for the blouse, another time for the pants.

4.1 Panel Packing

There is a limitation in the proposed panel tagging. For example, when the top consists of multiple panels as shown in FIG. 3, the tagging cannot resolve the situation completely with (Top, Front, *) and (Top, Back, *) only.

In view of such limitation, one might think of giving up the panel tagging idea altogether. But we note that, if we dismiss the tagging, garment construction is more or less a jigsaw puzzle situation. Unfortunately, it is not a well-posed jigsaw puzzle; We can create a case consisting of many small panels for which only the original designer knows the answer.

This paper proposes a new but very effective approach to cope with the above limitation of panel tagging, which forms another main finding of this paper. We note that, when the clothing expert designs the garment, he/she knows how those panels should be packed. The basic idea of panel packing is to utilize that knowledge. More specifically, when multiple panels are tagged to the identical tag, the clothing expert should pack the panels such that they are moved as a group (with their relative position being fixed) in the subsequent positioning.

5. AUTOMATIC SEAM CREATION

Placing the panels at sensible positions and identifying the matching seam line pairs are challenging task. This section shows that a surprisingly simple solution can be formulated when the above tag-and-pack scheme is employed.

To facilitate seam creation and to avoid potential problems during the draping simulation, positioning of the panels needs to satisfy in general the following three conditions:

Condition 1: The line pair to be sewn together should be positioned sufficiently close.

Condition 2: Panels should not penetrate the body.

Condition 3: The seam sweep (the sweep defined between the matching seam line pair.) should not penetrate the body.

We find that positioning the panels on the surface of the cylinder such that the panels are translated while attached to the cylinder surface is a very effective means to meet the above conditions.

Our main idea in the development of automatic seam creation is divide-and-conquer. We classify the seams into the following three categories:

Intra-Pack Seams: used for seaming the lines belonging to the same pack.

Inter-Pack Seams: used for seaming the lines belonging to two different packs. We further categorize the inter-pack seams into the inter-half-cylinder seams (that join the front and back half cylinders) and the inter-cylinder seams (that join two cylinders).

Inter-Layer Seams: consist of the T-seams and Y-seams (see Section 4.1).

Figure 6:
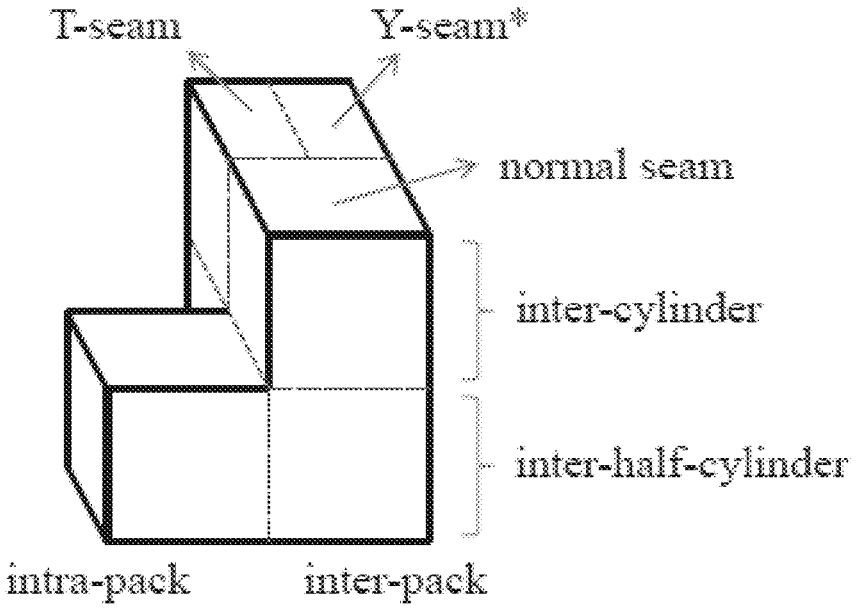
FIG. 6 shows complete classification of the seam lines, * indicating the seam lines that need to be explicitly secondary-tagged by the user.

TAGCON uses different methods for seaming the above three categories. In summary, FIG. 6 shows the complete TAGCON classification of the seam lines, in which only the layered-seam lines need explicit secondary tagging.

5.1 Creating the Intra-Pack Seams

Figure 7:
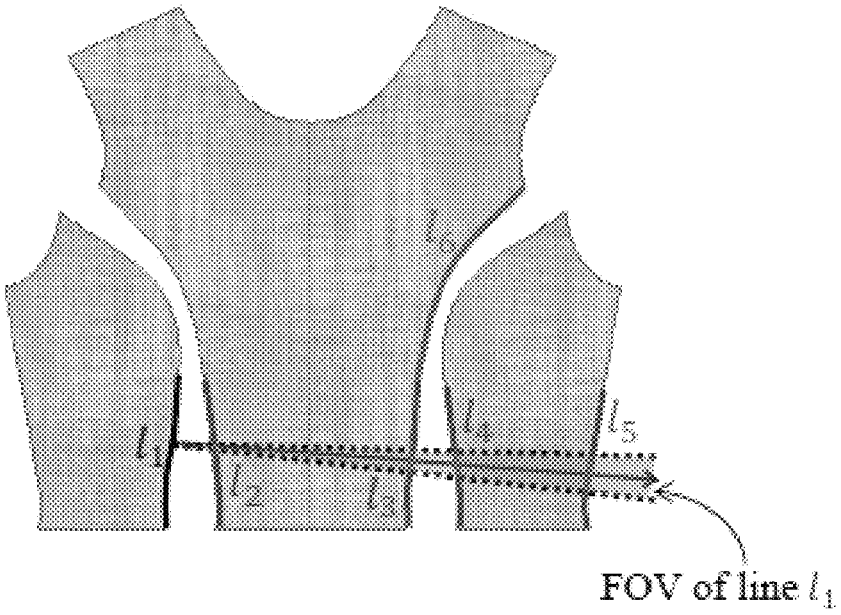
FIG. 7 shows that lines 12, 13, 14, 15 are in the FOV of line 11, and the closest line 12 is regarded as the matching seam line pair for 11.
Figure 8:
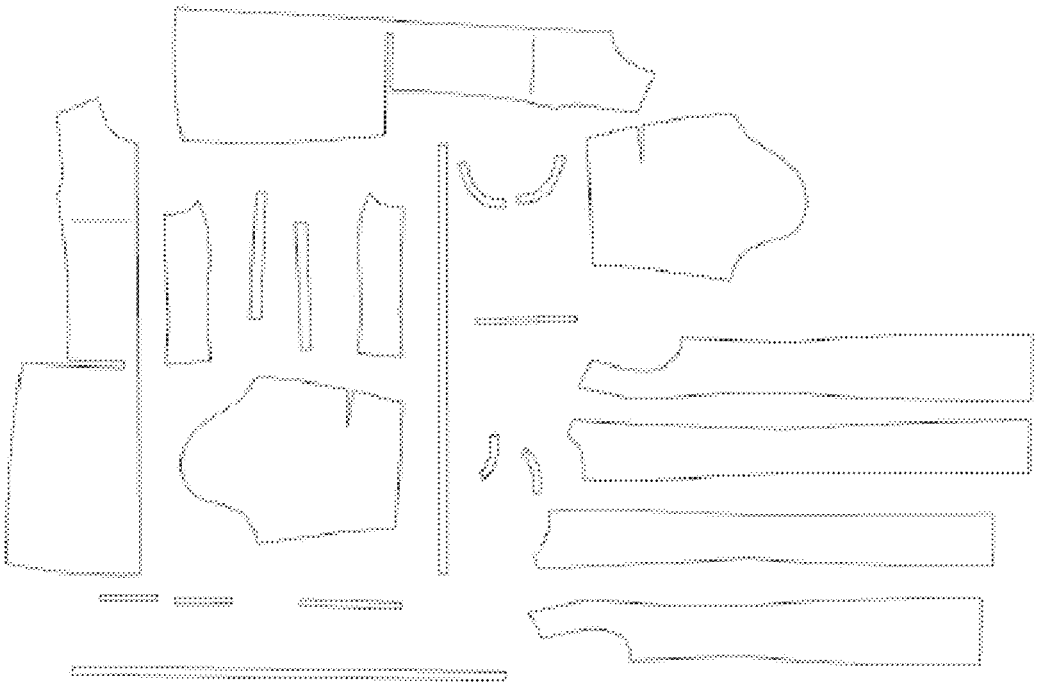
FIG. 8 shows panels for the rightmost garment of FIG. 1.

TAGCON assumes that the user composes the pack such that every matching seam line pair are closest neighbor to each other (i.e., no other line comes between them.). Then, the intra-pack seams can be identified by the following simple algorithm:

For all lines $l_i$ in the same pack,

1. Find the closest line among the ones that comes within the FOV of $l_i$. (The FOV (field of view) is defined from the center of the line as diagrammed in FIG. 7, where the spread angle is a user-controlled parameter.)
2. If there is no such line within the FOV, then $l_i$ is categorized as an inter-pack seam line.

5.1 Creating the Inter-Pack Seams

Identifying the inter-pack seams calls for a more complex algorithm than identifying the intra-pack seams. For estimating the probability whether two candidate lines in 3D should be inter-pack seamed, TAGCON uses the following criteria:

$M_{id}$: The distance should be short.

$M_{lo}$: The FOV of the two planar normals (i.e., the (unit) normal within the common plane) should be small.

$M_{ll}$: The length should be similar.

$M_{lc}$: The curvature should be similar.

$M_{sa}$: The lines should be seamable. If the two lines belong to non-adjacent cylinders (e.g., sleeve and pants), the two lines are inherently unseamable. There are occasions in which two lines belonging to two adjacent cylinders should never be seamed. For example the inner lines of the pants should not be seamed with outer lines. Such cases will be called conventionally unseamable. The conventional unseamablility is garment specific knowledge, and can be different for each garment type.

Based on the above criteria, we define the objective function M (i, j) for finding the matching inter-pack seam lines as $$M(i, j) = M_{id}(i, j)M_{lo}(i, j)M_{ll}(i, j)M_{lc}(i, j)M_{sa}(i, j), \text{ where} \quad (1)$$

$$M_{id}(i, j) = \frac{d_{max} - \|p_i - p_j\|}{d_{max}}, \quad (2)$$

$$M_{lo}(i, j) = \frac{1 - n_i \cdot n_j}{2}, \quad (3)$$

$$M_{ll}(i, j) = \frac{L_{diff} - |L_i - L_j|}{L_{diff}\kappa_{diff}}, \quad (4)$$

$$M_{lc} = \frac{-|\kappa_i - \kappa_j|}{\kappa_{diff}} \quad (5)$$

$$M_{sa}(i, j) = 0 \text{ or } 1. \quad (6)$$

Equation 2 represents the proximity, where $d_{max}$ is the threshold distance (a controllable parameter), $p_i$ and $p_j$ are the positions of line i and j. Equation 3 represents the orientation match, where $n_i$, $n_j$ are the planar normals of line i and j, respectively. Equation 4 represents the length match, where $L_{diff}$ is the threshold length difference (a controllable parameter), $L_i$ and $L_j$ are the lengths of line i and j, respectively. Equation 5 represents the curvature match, where κdiff is the threshold curvature difference (a controllable parameter), $\kappa_i$ and $\kappa_j$ are the curvatures of line i and j, respectively. Equation 6 represents the seamability, which takes either zero or one based on the line pair's inherent and conventional unseamability.

When the intra-pack seams are completed, then all the remaining seam lines have to be inter-pack or inter-layer seamed. Since all the inter-layer seams are already tagged or identified (see Section4.1), only the inter-pack seams are not yet known whether it should be inter-half-cylinder or inter-cylinder seamed. TAGCON performs that particular classification based on the pre-established garment construction theory. Then, TAGCON creates the inter-half-cylinder seams first, then the inter-cylinder seams according to the following two procedures, respectively.

5.2.1 Creating the Inter-Half-Cylinder Seams

Since the two half cylinders are aligned in 3D, identification of the matching inter-half-cylinder seam lines can be done straightforwardly, thus the details are omitted.

5.2.2 Creating the Inter-Cylinder Seams

The matching inter-cylinder seam lines are identified in the following procedure.

1. For a particular line i, calculate the objective function value M (i, j) for all the adjacent lines j in the other cylinder to find the best individual match for i.
2. Find the best ring match by rotating the distal cylinder about the axis and calculating the circumferential summation of M (i, j). From the best individual match, only three clockwise and counterclockwise clicks were enough to find the best ring match for the cases shown in this paper.

5.3 Creating the Inter-Layer Seams

At this point, the panels are layered thus the lines subject to the T- and Y-seams are in their 3D position. Since these lines are conspicuous from other types of lines, creation of the seams between them can be done by looking at the value of M (i, j).

6. RESULT

Figure 1:
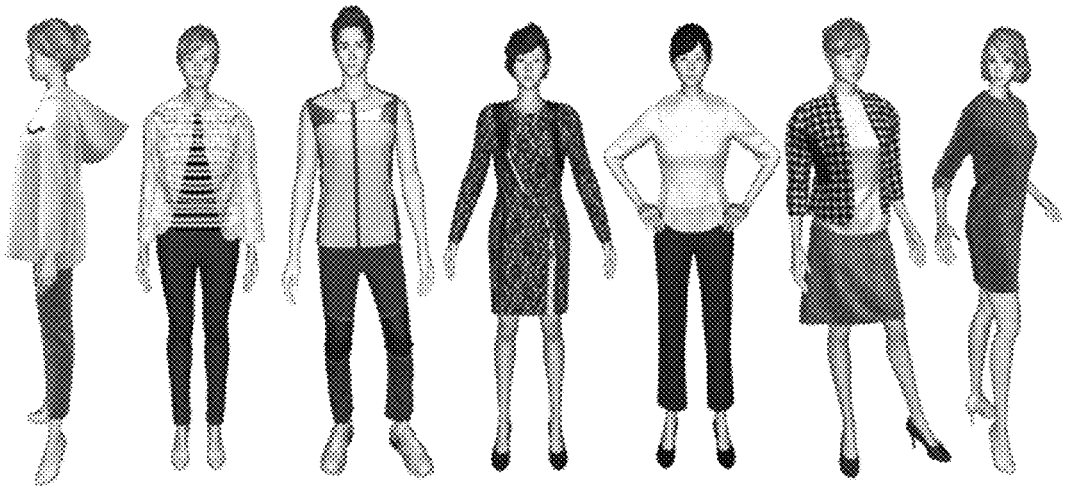
FIG. 1 shows sample garments which are automatically constructed according to the invention.
Figure 9:
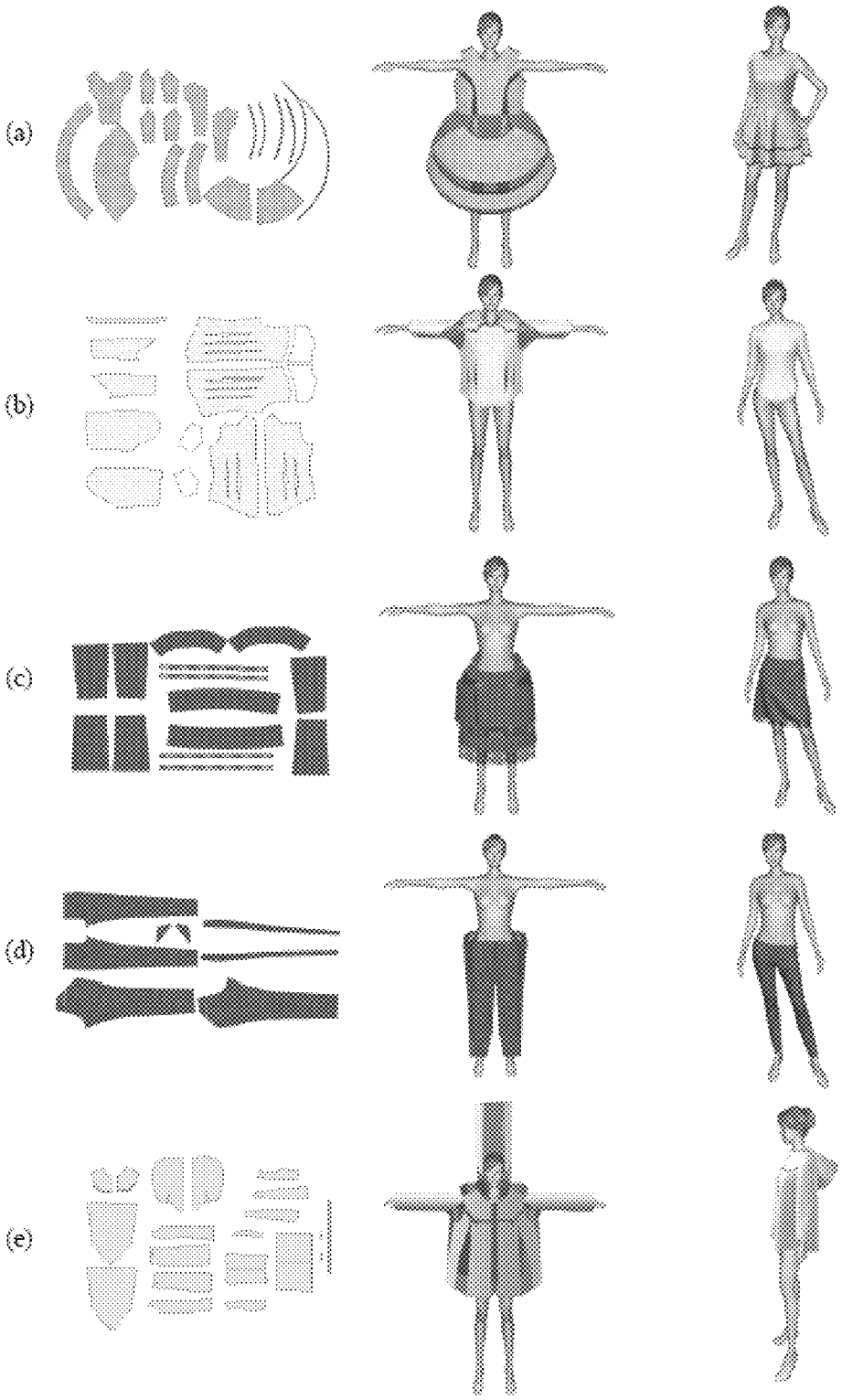
FIG. 9 shows five sample garments: (a) one-piece, (b) blouse, (c) skirt, (d) pants, (e) hooded top with the input panels, automatically created seams, and draped.

From the clothing experts, we got the total of thirty sample garments of various types (including blouse, one-piece, skirt, pants, T-shirt, hooded top, outdoor, etc.) to test TAGCON. First we performed the tagging-and-packing for all the samples, which took in average about two minutes per garment. Preprocessing took about 30 seconds for the simplest garment, and about 3 minutes for the most complex garment. Then, we created the 3D garment automatically using the proposed method described in Section 5, which took less than 5 seconds for all the sample garments. When the clothing experts created the above samples without TAGCON, the simplest garment took about 5 minutes and the most complex one took about 1.2 hours. FIGS. 1 and 9 show that our method can create various kinds of garments.

The proposed method successfully created 29 garments out of 30 tested samples. TAGCON provides the visual cue about the certainty of the identified matching seams as shown in FIG. 3; The seam sweep is shown in blue when it is completely certain and in red when it is completely uncertain. If there is a problem, such visual cue is helpful to interactively locate the problematic place.

We draped the resultant garments on the virtual human model. We used a physically-based clothing simulator which uses the stretch and shear models from Baraff et al [1998] and Choi and Ko [2002], and hinge-based bending model from Grinspun et al [2003].

The garment shown in FIG. 3 and some garments in FIG. 9 are composed of panels of quite unique shapes. It is difficult to accommodate those non-conventional cases with the machine learning based method. Those are the examples that demonstrate TAGCON is flexible in covering various types of garments.

Figure 10:
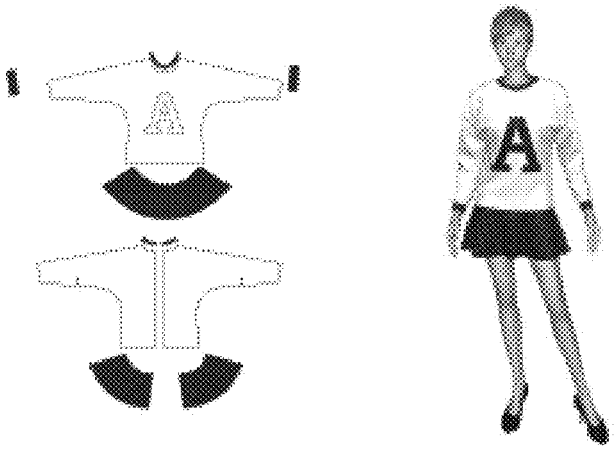
FIG. 10 shows a garment which cannot be automatically created with the invention.

TAGCON is based on the cylindrical abstraction; It assumes that each panel can be assigned to a cylinder. If a panel cannot not belong to a cylinder, it is difficult to locate the panel. For instance, in the top front panel (which bears the character "A") of FIG. 10, sleeve panels are not separated, so it cannot be accommodated to a cylinder. Such kind of non-conventional garments (1 among 30 sample garments) could not be processed with TAGGON, but that incapacity was deterministic and predictable.

7. CONCLUSION

This paper presented a new technique called TAGCON, which constructs the 3D virtual garment from the given tagged and packed panels. Tagging and packing should be done from the user, which involves simple labeling and 2D manipulation of the panels, but does not involve any 3D manipulation. Then, TAGCON constructs the garment automatically via the proposed algorithms (1) to position the panels at sensible locations around the body, and (2) to find the matching seam lines and create the seam.

TAGCON takes a deterministic approach and allows inter-layer seams (T-seams and Y-seams), which contribute to increasing the complexity of the garment the method can accommodate. The method can construct the garments shown in FIG. 1 instantly. We believe the proposed technique is a small step forward to make the graphically created garments appear in commercial virtual try-on systems.

We finally note the practical significance of the proposed method. First of all, the method clearly reduces the time taken for the garment construction. In addition to the construction time reduction itself, we would like to highlight that the method reduced the variation of the construction time across different garments. Without this technique the time varies from minutes to hours, but with the technique the time varies from 0.5 to 3 minutes for the examples shown in this paper. TAGCON also significantly reduces the variation of the construction time between the novice and expert users. As a consequence, TAGCON allows the construction job to be scheduled more predictably. Secondly, the method dramatically reduces the cumbersomeness. Considering the trial-and-error they experience without the technique, the users perceive this reduction more critical than the time reduction.

As aspect of the invention provides a method for constructing 3D garment.

The method comprises steps for:

providing a plurality of panels of a garment so as to be processed in an information processing device, wherein each of the plurality of panels comprises seam lines;

positioning the plurality of panels at corresponding locations around a virtual body provided in the information processing device;

finding matching seam lines for the plurality of panels and creating seams; and producing the garment in which the plurality of panels are positioned, seamed, and draped on the virtual body.

The step for positioning may comprise a step for panel tagging, in which each of the plurality of panels is tagged by a user based on a cylindrical abstraction, such that the panel is positioned properly.

The step for positioning may further comprise a step for seam line tagging, in which each of the seam lines is tagged by the user, such that the matching seam lines are related properly.

The step for positioning may further comprise a step for panel packing, in which related panels are grouped and packed, such that relative positions are fixed among the packed panels, and the packed panels move as a group.

A panel may be tagged as (α,β,γ), in which α, β, and λ are predicates regarding P, wherein α designates the particular cylinder, and β takes either Front or Back, and λ represents the layer to which P belongs.

λ=±1, ±2, . . . to encode the outer/inner layers.

The step for positioning may comprise a step for determining:

if the line pair to be sewn together is positioned sufficiently close;

if panels do not penetrate the body; and if a seam sweep (the sweep defined between the matching seam line pair) does not penetrate the body.

The step for positioning may further comprise a step for traslating the panels while attached to a surface of cylinder for the cylindrical abstraction.

The step for creating seams may comprise a step for classifying the seams into three categories:

intra-pack seams used for seaming seam lines belonging to a same pack;

inter-pack seams used for seaming seam lines belonging to two different packs; and inter-layer seams consisting of T-seams and Y-seams, wherein the seam is made with an interior line in the T-seam, and multiple panels are seamed with a single contour in the Y-seam.

The inter-pack seams may be further categorised into the inter-half-cylinder seams (that join the front and back half cylinders) and the inter-cylinder seams (that join two cylinders).

The Y-seam lines may be explicitly tagged through a secondary seam line tagging by the user.

The probability whether two candidate lines in 3D are inter-pack seamed may be estimated using criteria including:

$M_{ld}$: The distance is short;

$M_{lo}$: The FOV of the two planar normals is small;

$M_{ll}$: The length should be similar;

$M_{lc}$: The curvature should be similar; and $M_{sa}$: The lines should be seamable.

An objective function M (i, j) used for finding the matching inter-pack seam lines may be defined as $$M(i, j) = M_{ld}(i, j)M_{lo}(i, j)M_{ll}(i, j)M_{lc}(i, j)M_{sa}(i, j), \text{ where} \tag{1}$$

$$M_{ld}(i, j) = \frac{d_{max} - \|p_i - p_j\|}{d_{max}}, \tag{2}$$

$$M_{lo}(i, j) = \frac{1 - n_i \cdot n_j}{2}, \tag{3}$$

$$M_{ll}(i, j) = \frac{L_{diff} - |L_i - L_j|}{L_{diff}\kappa_{diff}}, \tag{4}$$

$$M_{lc} = \frac{-|\kappa_i - \kappa_j|}{\kappa_{diff}} \tag{5}$$

$$M_{sa}(i, j) = 0 \text{ or } 1. \tag{6}$$

in which Eq. (2) represents the proximity, where $d_{max}$ is the threshold distance (a controllable parameter), $p_i$ and $p_j$ are the positions of line i and j, Eq. (3) represents the orientation match, where $n_i$, $n_j$ are the planar normals of line i and j, respectively, Eq. (4) represents the length match, where $L_{diff}$ is the threshold length difference (a controllable parameter), $L_i$ and $L_j$ are the lengths of line i and j, respectively, Eq. (5) represents the curvature match, where κdiff is the threshold curvature difference (a controllable parameter), $\kappa_i$ and $\kappa_j$ are the curvatures of line i and j, respectively, and Eq. (6) represents the seamability, which takes either zero or one based on the line pair's inherent and conventional unseamability.

Matching inter-cylinder seam lines may be identified by steps for:

for a particular line i, calculating the objective function value M (i, j) for all the adjacent lines j in the other cylinder to find the best individual match for i; and finding the best ring match by rotating the distal cylinder about the axis and calculating the circumferential summation of M (i, j).

The embodiments are performed in at least one information processing device such as a computer. Each of the steps is related with computing in a CPU and storing and retrievining data to and from a memory, and changing the computer-readerable data or information in the information processing device. And the results may be obtained in a form or format of computer- or device-readable data. Also the results may be adapted to be displayed on a computer monitors or equivalents. All the necessary data structure for representing the data or command codes are implied and well-known to the community.

REFERENCES

BARAFF, D., AND WITKIN, A. 1998. Large steps in cloth simulation. In *In Proc. of SIGGRAPH* 98, ACM, New York, N.Y., USA, 43-54.

BERTHOUZOZ, F., GARG, A., KAUFMAN, D. M., GRINSPUN, E., AND AGRAWALA, M. 2013. Parsing sewing patterns into 3d garments. *ACM Transactions on Graphics* 32, 4 (July), 85:1-85:11.

CHOI, K.-J., AND KO, H.-S. 2002. Stable but responsive cloth. In *In Proc. of ACM SIGGRAPH* 02, ACM, New York, N.Y., USA, 604-611.

CORDIER, F., SEO, H., AND MAGNENAT-THALMANN, N. 2003. Made-to-measure technologies for an online clothing store. *IEEE Computer graphics and applications* 23, 1, 38-48.

DECAUDIN, P., JULIUS, D., WITHER, J., BOISSIEUX, L., SHEFFER, A., AND CANI, M.-P. 2006. Virtual garments: A fully geometric approach for clothing design. In *Computer Graphics Forum, vol.* 25, Wiley Online Library, 625-634.

FONTANA, M., CARUBELLI, A., RIZZI, C., AND CUGINI, U. 2005. Clothassembler: a cad module for feature-based garment pattern assembly. *Computer-Aided Design and Applications* 2, 6, 795-804.

GRINSPUN, E., HIRANI, A. N., DESBRUN, M., AND SCHRÖDER, P. 2003. Discrete shells. In *Proceedings of the* 2003 *ACM SIGGRAPH/Eurographics Symposium on Computer Animation*, Eurographics Association, Aire-la-Ville, Switzerland, Switzerland, SCA '03, 62-67.

GUAN, P., REISS, L., HIRSHBERG, D. A., WEISS, A., AND BLACK, M. J. 2012. Drape: Dressing any person. *ACM Trans. Graph.* 31, 4 (July), 35:1-35:10.

HARALICK, R. M., AND QUEENEY, D. 1982. Understanding engineering drawings. *Computer Graphics and Image Processing* 20, 3, 244-258.

IGARASHI, T., AND HUGHES, J. F. 2002. Clothing manipulation. In *Proceedings of the* 15*th Annual ACM Symposium on User Interface Software and Technology*, ACM, New York, N.Y., USA, UIST '02, 91-100.

MENA, J. B. 2003. State of the art on automatic road extraction for gis update: A novel classification. *Pattern Recogn. Lett.* 24, 16 (December), 3037-3058.

MENG, Y., MOK, P. Y., AND JIN, X. 2010. Interactive virtual try-on clothing design systems. *Comput. Aided Des.* 42, 4 (April), 310-321.

MENG, Y., MOK, P. Y., AND JIN, X. 2012. Computer aided clothing pattern design with 3d editing and pattern alteration. *Comput. Aided Des.* 44, 8 (August), 721-734.

MENG, Y., WANG, C. C. L., AND JIN, X. 2012. Flexible shape control for automatic resizing of apparel products. *Comput. Aided Des.* 44, 1 (January), 68-76.

PROTOPSALTOU, D., LUIBLE, C., AREVALO, M., AND MAGNENAT-THALMANN, N. 2002. A body and garment creation method for an internet based virtual fitting room. In *Advances in Modelling, Animation and Rendering*. Springer, 105-122.

ROBSON, C., MAHARIK, R., SHEFFER, A., AND CARR, N. 2011. Smi 2011: Full paper: Context-aware garment modeling from sketches. *Comput. Graph.* 35, 3 (June), 604-613.

TURQUIN, E., CANI, M.-P., AND HUGHES, J. F. 2004. Sketching garments for virtual characters. In *In Courses, ACM*, J. A. Jorge and J. F. Hughes, Eds., *SIGGRAPH* 06, 175-182.

TURQUIN, E., WITHER, J., BOISSIEUX, L., CANI, M.-P., AND HUGHES, J. F. 2007. A sketch-based interface for clothing virtual characters. *IEEE Comput. Graph. Appl.* 27, 1 (January), 72-81.

UMETANI, N., KAUFMAN, D. M., IGARASHI, T., AND GRINSPUN, E. 2011. Sensitive couture for interactive garment modeling and editing. *ACM Transactions on Graphics* (*Proc. of SIGGRAPH* 2011) 30, 4, 90.

WANG, C. C. L., WANG, Y., AND YUEN, M. M. 2003. Feature based 3d garment design through 2d sketches. *Computer-Aided Design* 35, 7, 659-672.

What is claimed is:

1. A method for constructing 3D garment, the method comprising steps for:

providing a plurality of panels of a garment so as to be processed in an information processing device, wherein each of the plurality of panels comprises seam lines;

positioning the plurality of panels at corresponding locations around a virtual body provided in the information processing device;

finding matching seam lines for the plurality of panels and creating seams; and producing the garment in which the plurality of panels are positioned, seamed, and draped on the virtual body, wherein the step for positioning comprises a step for panel tagging, in which each of the plurality of panels is tagged by a user based on a cylindrical abstraction, such that the panel is positioned properly, wherein the step for positioning further comprises a step for seam line tagging, in which each of the seam lines is tagged by the user, such that the matching seam lines are related properly, wherein the step for positioning further comprises a step for panel packing, in which related panels are grouped and packed, such that relative positions are fixed among the packed panels, and the packed panels move as a group, wherein the step for creating seams comprises a step for classifying the seams into three categories:

intra-pack seams used for seaming seam lines belonging to a same pack;

inter-pack seams used for seaming seam lines belonging to two different packs; and inter-layer seams consisting of T-seams and Y-seams, wherein the seam is made with an interior line in the T-seam, and multiple panels are seamed with a single contour in the Y-seam, wherein the inter-pack seams are further categorised into the inter-half-cylinder seams (that join the front and back half cylinders) and the inter-cylinder seams (that join two cylinders), wherein estimating the probability whether two candidate lines in 3D are inter-pack seamed, wherein an objective function M (i, j) used for finding the matching inter-pack seam lines, which is defined as $$M(i,j)=M_{ld}(i,j)M_{lo}(i,j)M_{ll}(i,j)M_{lc}(i,j)M_{sa}(i,j), \quad (1)$$

where $$M_{ld}(i,j)=(d_{max}-//p_i-pj//)/d_{max}, \quad (2)$$

$$M_{lo}(i,j)=(1-n_i \cdot n_j)/2, \quad (3)$$

$$M_{ll}(i,j)=(L_{diff}-|L_i-L_j|)/L_{diff}, \quad (4)$$

$$M_{lc}(i,j)=(\kappa_{diff}-|\kappa_i-\kappa_j)/\kappa_{diff}, \quad (5)$$

$$M_{sa}(i,j)=0 \text{ or } 1. \quad (6)$$

in which Eq. (2) represents the proximity, where dmax is the threshold distance (a controllable parameter), pi and pj are the positions of line i and j, Eq. (3) represents the orientation match, where ni, nj are the planar normals of line i and j, respectively, Eq. (4) represents the length match, where Ldiff is the threshold length difference (a controllable parameter), Li and Lj are the lengths of line i and j, respectively, Eq. (5) represents the curvature match, where Kdiff is the threshold curvature difference (a controllable parameter), κi and κj are the curvatures of line i and j, respectively, and Eq. (6) represents the seamability, which takes either zero or one based on the line pair's inherent and conventional unseamability.

2. The method of claim 1, wherein a panel is tagged as (α,β,γ), in which α, β, and λ are predicates regarding P, wherein α designates the particular cylinder, and β takes either Front or Back, and λ represents the layer to which P belongs.

3. The method of claim 2, wherein λ=±1, ±2, . . . to encode the outer/inner layers.

4. The method of claim 1, wherein the step for positioning comprises a step for determining:

if the line pair to be sewn together is positioned sufficiently close;

if panels do not penetrate the body; and if a seam sweep (the sweep defined between the matching seam line pair) does not penetrate the body.

5. The method of claim 4, wherein the step for positioning further comprises a step for traslating the panels while attached to a surface of cylinder for the cylindrical abstraction.

6. The method of claim 1, wherein the Y-seam lines are explicitly tagged through a secondary seam line tagging by the user.

7. The method of claim 1, wherein matching inter-cylinder seam lines are identified by steps for:

for a particular line i, calculating the objective function value M (i, j) for all the adjacent lines j in the other cylinder to find the best individual match for i; and finding the best ring match by rotating the distal cylinder about the axis and calculating the circumferential summation of M (i, j).

* * * * *